US007086257B2

(12) United States Patent
Bücker et al.

(10) Patent No.: US 7,086,257 B2
(45) Date of Patent: Aug. 8, 2006

(54) LOCK SYSTEM WITH A FUNCTION CONTROLLING MECHANISM

(75) Inventors: Rolf Bücker, Coburg (DE); Uwe Sommer, Effelder (DE); Jörg Übelein, Grub am Forst (DE); Andre Görtz, Dresden (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 0 days.

(21) Appl. No.: 10/432,142

(22) PCT Filed: Nov. 16, 2001

(86) PCT No.: PCT/DE01/04380

§ 371 (c)(1),
(2), (4) Date: Sep. 29, 2003

(87) PCT Pub. No.: WO02/40812

PCT Pub. Date: May 23, 2002

(65) Prior Publication Data

US 2004/0050121 A1 Mar. 18, 2004

(30) Foreign Application Priority Data

Nov. 17, 2000 (DE) ..... 100 57 007

(51) Int. Cl.
*B60R 25/00* (2006.01)

(52) U.S. Cl. ..... 70/256; 70/237; 70/264; 292/DIG. 23; 292/DIG. 25; 292/201; 292/216

(58) Field of Classification Search ..... 70/256, 70/257, 277, 264, 237; 292/DIG. 23, 25, 292/201, 216

See application file for complete search history.

(56) References Cited

U.S. PATENT DOCUMENTS 4,459,834 A * 7/1984 Seki ..... 70/256
4,762,348 A * 8/1988 Matsumoto ..... 292/201
5,117,665 A * 6/1992 Swan et al. ..... 70/264
5,666,834 A * 9/1997 Inoue ..... 70/237
5,915,766 A * 6/1999 Baumeister et al. ... 292/341.15

(Continued)

FOREIGN PATENT DOCUMENTS

DE 196 27 246 A1 1/1997

(Continued)

OTHER PUBLICATIONS

International Search Report of PCT/DE01/04380, dated May 15, 2002.

(Continued)

*Primary Examiner*—Suzanne Dino Barrett
(74) *Attorney, Agent, or Firm*—Christie, Parker & Hale, LLP.

(57) ABSTRACT

A lock system is provided with a function controlling mechanism for control of the lock states unlocked, locked and optionally theft secure and child safety. The lock system is characterized by very short times for controlling the desired locking states and good suitability to various requirements with regard to construction space and functionality. The lock system comprises locking pieces, for example a turning latch or lock handle, in a lock for the mechanical locking of the door, at least one operating device in the form of an external door opener and/or an internal door opener, an optional locking cylinder, and elements for transmitting the operating force from the operating device to the locking pieces. The pieces of the function controlling mechanism (FSM), involved in controlling the locking state are not involved in the force path between the operating device and the locking pieces of the lock.

30 Claims, 17 Drawing Sheets

U.S. PATENT DOCUMENTS

| | | | | |
|---|---|---|---|---|
| 5,947,536 | A * | 9/1999 | Mizuki et al. | 292/201 |
| 6,003,910 | A | 12/1999 | Dupont et al. | |
| 6,017,067 | A * | 1/2000 | Yoneyama et al. | 292/216 |
| 6,062,613 | A | 5/2000 | Jung et al. | |
| 6,082,158 | A | 7/2000 | Wegner | |
| 6,338,508 | B1 * | 1/2002 | Kleefeldt | 292/201 |
| 6,343,494 | B1 * | 2/2002 | Roos et al. | 70/264 |
| 6,467,320 | B1 * | 10/2002 | Choo | 70/256 |
| 6,779,372 | B1 * | 8/2004 | Arlt et al. | 70/237 |

FOREIGN PATENT DOCUMENTS

| | | |
|---|---|---|
| DE | 198 41 670 A1 | 3/2000 |
| EP | 0 667 434 A1 | 8/1995 |
| EP | 0 989 265 A1 | 3/2000 |
| EP | 1 001 118 A1 | 5/2000 |
| EP | 1 004 731 A1 | 5/2000 |

OTHER PUBLICATIONS

International Preliminary Examination Report of PCT/DE01/04380, dated Apr. 3, 2003.

English Translation of International Preliminary Examination Report of PCT/DE01/04380, dated Apr. 3, 2003.

* cited by examiner

Fig. 20
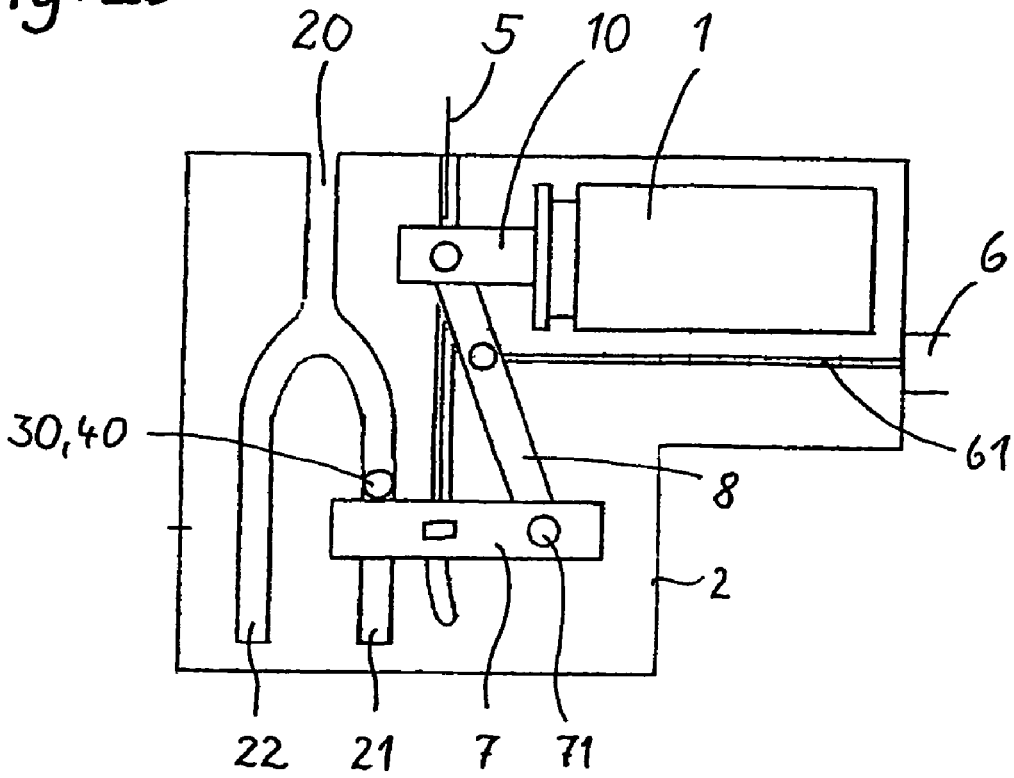
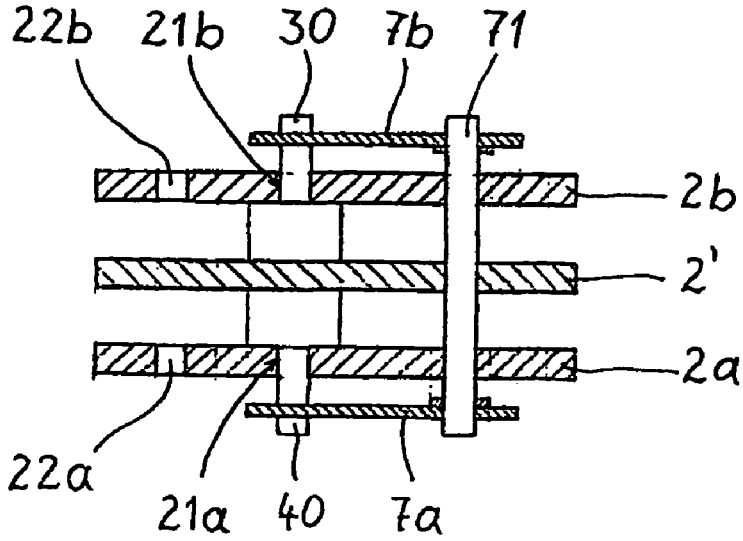
Fig. 21

LOCK SYSTEM WITH A FUNCTION CONTROLLING MECHANISM

CROSS-REFERENCE TO RELATED APPLICATION

This application is a National Phase Patent Application of International Application Number PCT/DE01/04380, filed on Nov. 16, 2001, which claims priority of German Patent Application Number 100 57 007.0, filed Nov. 17, 2000.

BACKGROUND OF THE INVENTION

The invention relates to a lock system with a function controlling mechanism for controlling the lock states "unlocked", "locked" and where applicable "theft-secured" as well as "child lock", which is characterised by very short times for controlling the desired locking states and good suitability to various requirements with regard to construction space and functionality.

In the case of motor vehicles having a so-called passive-entry function in which the locking of the lock is carried out not by a key but by an interrogation as to authorised status initiated by operating the external door opener followed by motorised unlocking of the lock, it may not be possible for the door to be opened immediately because the lock cannot be unlocked quickly enough. It is indeed fundamentally possible to shorten the operating time of the lock by using more powerful and faster drives but this involves a greater expense of materials and thus higher costs.

DE 196 27 246 A1 provides a motor vehicle door lock which can occupy different function positions. By means of a lift magnet, additional security is provided whereby the lift magnet at the same time serves for rapid release of the lock wherein the locking elements of the lock are moved from the "theft-proof" state to the "unlocked" state. The lift magnet is controlled by actuating the external door opener and in the shortest possible time produces a closed force chain for transferring the operating force whereby the elements moved by the lift magnet are part of the force chain.

This approach has the drawback that the lift magnet has to be made relatively powerful in order to be able to ensure a sufficiently fast movement of the masses which are to be moved. This involves large structural sizes inconsistent with a space-saving compact design.

SUMMARY OF THE INVENTION

An object of the invention is a lock system with a function controlling mechanism, more particularly a function controlling mechanism with a passive entry function whose switch times, when changing between two functioning positions, are shortened to an extent which is not significant in the operation of the lock system and without having to increase the cost of the drive.

Advantageously the function controlling mechanism forms a simple compact functionally reliable structural unit which can be combined with electric and electronic components as necessary and readily integrated into different vehicle locking systems.

According to an aspect of the invention, all parts of the function controlling mechanism lie outside of the force flow between the operating element and the locking part so that the switch processes are not influenced by the masses which have to be moved. Furthermore the switch paths are kept very small.

In one aspect, at least one switch element (e.g. a points element) is advantageously provided which can be controlled by a drive and which, depending on its position, controls the movement of a coupling element on the operating element side which transfers the operating force, such that this coupling element enters into active relationship with a coupling element on the locking part side as necessary and transfers the positioning movement to the locking mechanism with the interposition of further elements (e.g. Bowden cable and/or lever mechanism). Operating element side and locking part side refer to sides of the function controlling mechanism, i.e. the lock system of the invention that the operating element and locking part are respectively connected to. The operating element or operating device may be an internal door opener or an external door opener. A lift magnet, a rotary magnet or a flap armature, which can switch back and forth between two end positions, can be used as the drive for the controllable switch element. Step motors or direct current motors with gears can also be used in other embodiments.

In order to provide the functional reliability of the switch processes, the involved elements are designed to preclude indeterminate intermediate positions. This is simply achieved through stops which the switch elements contact by means of the associated drive and which restrict the switch path of the switch element. The desired precision can however also be achieved by using bi-stable spring elements which advantageously jump over into one of two stable end positions.

In the case where guide tracks depict the displacement path of the coupling element on the operating element side, the one end position of the movable part (e.g. the points element) represents the establishment of the active connection for the purpose of transferring the operating force, and the other end position of the movable part represents the interruption of the active connection so that an operating force starting from a door opener cannot be transferred to the locking parts of the lock.

When using a guide track having at least one fork for the coupling element on the operating element side, the switch element which can be controlled between the two end positions, functions as the points element whereby a first fork leads the coupling element on the operating element side to engage with the coupling element on the locking part side and a second fork prevents engagement of the coupling elements.

The guide tracks for the various coupling elements on the operating element side can be formed in different ways, e.g. in the form of a slide path, a slot, a rail or the like in or on which the coupling element on the operating element side is guided with sliding action. The guide track can alternatively be formed as a transversely sliding or pivotal or limitedly rotatable rail or the like on which the coupling element disposed on the operating element side is guided whereby the transfer of the operating force can take place in one of the end positions of the rail.

In other embodiments, various different designs of the points switch elements may be used. Thus the points element can be mounted pivotal or rotatable relative to a base which supports or forms the guide track. When using a guide track which can be displaced in translation across its extension direction, the coupling element disposed on the operating element side is selectively moved to engage with the coupling element on the locking part side or it may be selectively moved so that such engagement is prevented.

Another structural variation for controlling the path of the coupling element disposed on the operating element side exists where the coupling element is mounted displaceable along a plane of adjustable incline whereby displacement of the coupling element disposed on the operating element side along the inclined or straight plane, prevents or produces its engagement on the coupling element on the locking part side. The conversion of the straight plane into an inclined plane can be carried out by swivelling a part mounted on a base or by sliding a preferably wedge-shaped part which after displacement releases the otherwise concealed inclined plane.

Another aspect of the invention provides that the coupling element disposed on the operating element side is guided along a transversally displaceable guide track whereby the displacement across the extension direction of the guide track selectively permits or prevents engagement of the coupling element disposed on the operating element side with the coupling element disposed on the locking part side.

In order to couple the operating forces which emanate from the door openers, a simple non-forked guide track may be provided for the operating element on the locking part side into which an operating lever connected to the coupling element on the lock side can be displaced so that the operating lever crosses the guide track and can enter into engagement with the coupling element. Moving the operating lever is likewise carried out by means of a drive which is activated through corresponding control commands or—in the case of emergency operation when the on-board electric supply fails—by actuating the locking cylinder, In order to achieve the most compact construction possible for the function controlling mechanism, the force-transferring means, e.g. operating cable or operating rod linkage which are directly connected to the coupling elements disposed on the operating element side in the various embodiments, are mounted on the one side of a base plate or the like supporting the guide tracks whereas the means for force transfer connected to the coupling element on the locking part side are mounted on the other side of this base. The coupling elements disposed on the operating element side in the various embodiments, project sufficiently far beyond the base so that during their displacement along the guide track, an engagement can be produced with a part such as a pivotally mounted operating lever, connected to the coupling element on the locking part side. The device can be made more compactly and the cost of component parts considerably reduced through symmetrical construction of a part of the mechanical structural elements or function regions on the external door opener side and the internal door opener side. In one symmetric arrangement, the guide tracks for the coupling elements on the operating element side are positioned so that the transfer of the operating force to the coupling element on the lock side can be undertaken by a common operating element.

In another embodiment, the component parts and function regions may be positioned in superposed planes.

For manually controlling the different switch states of the lock, the function controlling mechanism has a switch lever which is pivotally mounted in its middle region. Its ends may include stops which are connected to followers of the control rod linkage which is connected to the drives. Between the pivotal axis of the switch lever and one of its ends, a force transfer element (e.g. cable) engages which is connected to the locking cylinder of the vehicle door so that when the locking cylinder is actuated in the "OPENING" or "CLOSING" direction, the switch elements can be brought into the corresponding switch positions for the purpose of emergency opening or emergency closing.

A pivotal operating lever may be advantageously mounted on the same axis with its ends engaging with the coupling elements which are displaceable along the guide tracks when the lock is unlocked and an operating force is introduced through one of the door openers. The operating lever is thereby pivoted and transfers to a force transfer element on the lock side engaging at a distance from the pivotal axis a setting path which finally leads to opening of the lock.

Another aspect of the invention combines the function controlling mechanism with an electronic lock control which inter alia ensures the so-called passive entry function wherein an interrogation of the access authorisation is carried out through remote means and then the lock may be moved into the unlocked state. An antenna integrated into the lock control or its housing ensures a short signal transmission path. It is also advantageous to allocate directly to the electronic lock control sensors or micro switches which signal the actuation of a door handle.

The function controlling mechanism and the electronic lock control may form one structural unit. A synergy effect can be achieved in that the conductor plate of the electronic lock control simultaneously serves as a mechanical support for the structural elements or function regions of the function control mechanism.

In an exemplary embodiment, the drives can be fixed and simultaneously electrically contacted on a base such as the conductor plate. The same applies to the sensors which monitor the existing lock states, plugs and switches. Furthermore the conductor plate can also undertake purely mechanical tasks e.g. through integration of the guide tracks for the coupling elements on the operating element side and the bearing sites, or similarly for the points elements and the pivotal axes.

A compact highly integrated mechanical-electronic function controlling device of this kind forms a functionally reliable unit which can be manufactured cost-effectively and which can be pre-checked with regard to all of its functions.

BRIEF DESCRIPTION OF THE DRAWING

The invention will now be explained with reference to some embodiments and the accompanying drawings in which:

FIG. 20 is a diagrammatic view of the upper of several planes of a function controlling mechanism having a fork-like guide track;

FIG. 21 is a cross-section through the planes of the mechanism shown in FIG. 20;

DETAILED DESCRIPTION

Figure 1:
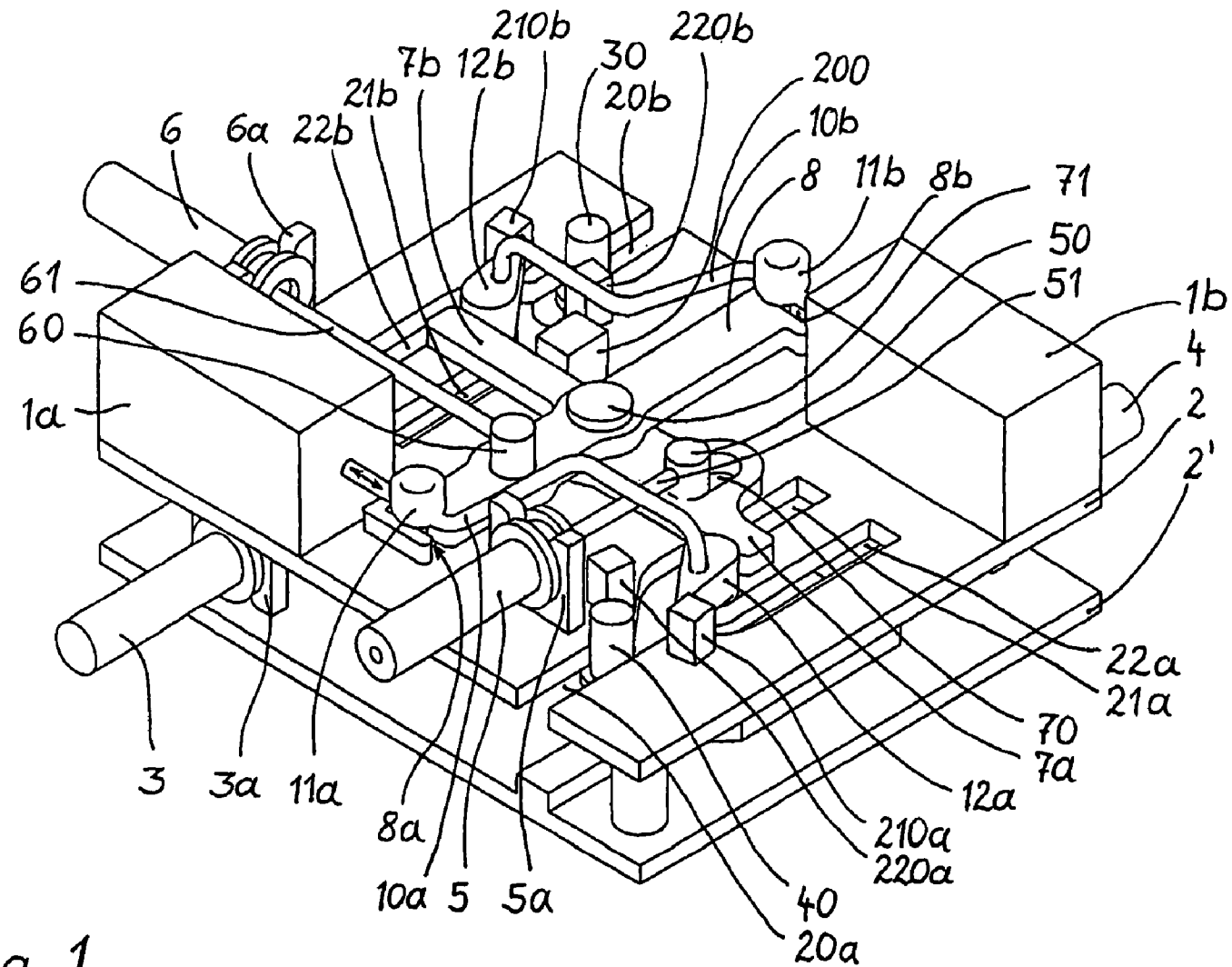
FIG. 1 is a perspective view of an exemplary function controlling mechanism of the present invention which includes two base plates and switch elements which are located in the "UNLOCKED" position.

The embodiment of a function controlling mechanism, illustrated in different functioning positions in FIGS. 1 to 8, has a lower base plate 2' and an upper base plate 2 spaced therefrom and on which drives 1*a*, 1*b* are arranged in the form of lift magnets in opposite corner regions. In other exemplary embodiments, drives 1*a* and 1*b* for the function controlling mechanism may be formed of components other than lift magnets. Each lift magnet, i.e. drives 1*a*, 1*b*, has an axially displaceable coupling rod 10*a*, 10*b* whose distal ends engage in respective openings 121*a*, 121*b* of swivel mounted switch elements 12*a*, 12*b*. The switch elements 12*a*, 12*b* are supported by axes 120*a*, 120*b* on webs 23*a*, 23*b* which separate the parallel guide tracks 21*a*, 21*b*, 22*a*, 22*b* formed in the base plate 2, from each other. Switch elements 12*a* and 12*b* include a pointed section that rotates to contact stops, and switch elements 12*a* and 12*b* may therefore be alternatively referred to as points-like switch elements 12*a*, 12*b*. The forked parallel guide tracks are combined in the neutral guide track 20*a*, 20*b* in which the coupling elements 30, 40 on the operating element side are mounted when no setting movement emanates from the door openers. For example, parallel guide tracks 21*a* and 22*a* form a forked configuration as they combine in neutral guide track 20*a* which accommodates coupling element 40. FIG. 1 also illustrates stop 200.

The Bowden tube ends 3, 4 on the operating element side are supported on fixing blocks 3*a* between the base plates 2, 2'. Bowden tube end 3 may be for transferring the operating force of an external door opener, or Bowden tube end 4 may be for transferring the operating force of an internal door opener. The Bowden tube ends 5, 6 which are connected to the lock or the locking cylinder are suspended in respective fixing blocks 5*a*, 6*a* above the base plate 2. Also the base bodies 32, 42 of the respective coupling elements 30, 40 connected to cable pulleys 31, 41, respectively, are mounted between the two base plates 2, 2' and ensure that the ends of the coupling elements 30, 40 projecting beyond the opposing side of the base plate 2 do not tilt on stopping against the operating lever 7. Bowden tube end 5 may be a connector element for transferring operating force to locking parts of the lock, and Bowden tube end 6 may be a connector element for transferring operating force of the locking cylinder.

Figure 2:
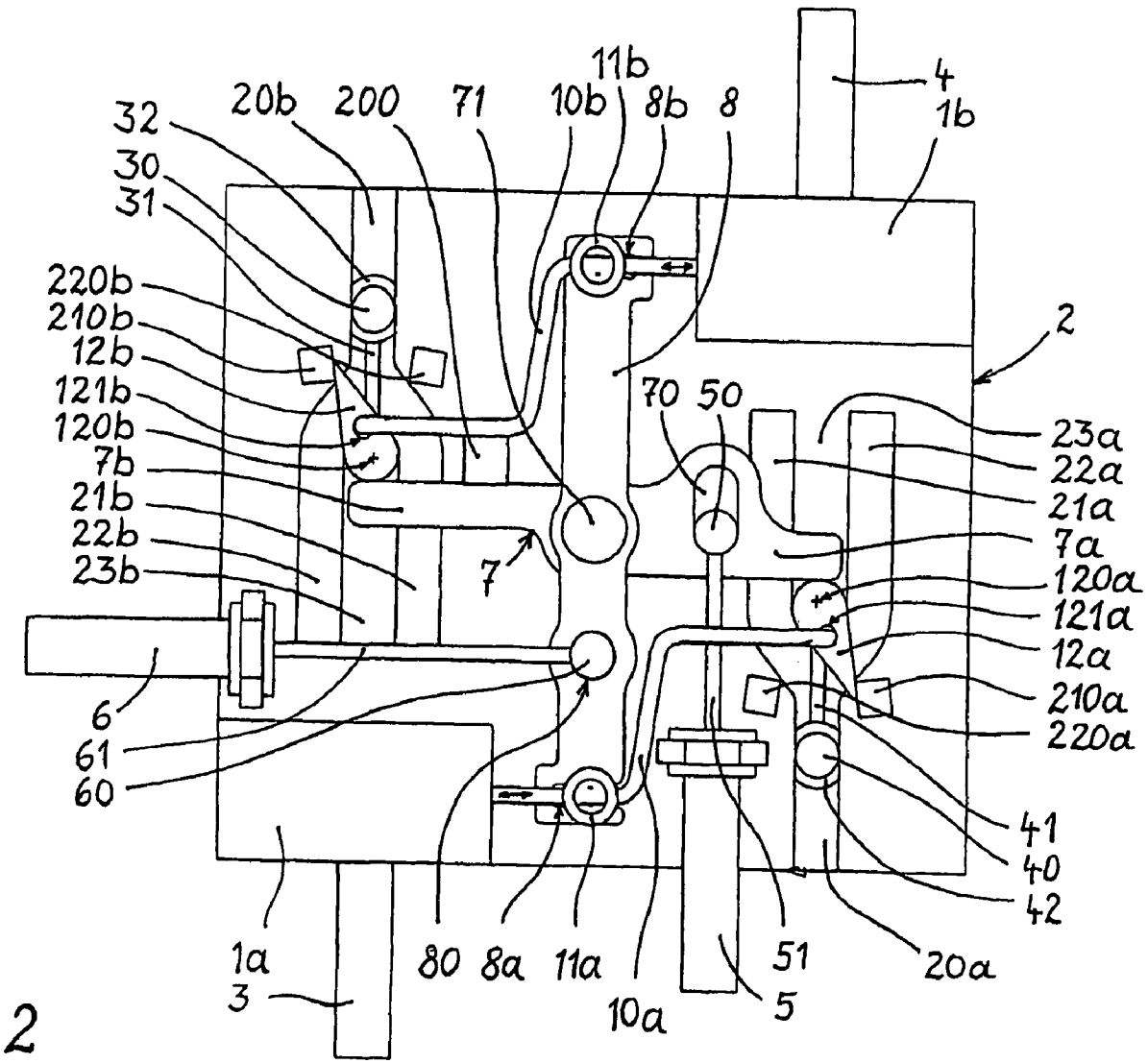
FIG. 2 is a plan view of the exemplary function controlling mechanism according to FIG. 1.

In FIGS. 1 and 2 the switch elements 12*a*, 12*b* are located in the "UNLOCKED" position, i.e. an operating force introduced through the Bowden tube ends 3, 4 and the cable pulleys 31, 41 from the external door opener or internal door opener (i.e. the operating element), can be transferred to the cable pulley 5 which is connected to the locking parts of the lock. For this purpose an operating lever 7 is pivotally mounted on the base plate 2 along axis 71. Ends 7*a*, 7*b* of operating lever 7 cross the inner guide tracks 21*a*, 21*b* of the forked areas and thus are in the engagement region of the coupling elements 30, 40 when the switch elements 12*a*, 12*b* bear against the stops 210*a*, 210*b* and thus release the change-overs from the neutral guide tracks 20*a*, 20*b* into the guide tracks 21*a*, 21*b*.

Figure 3:
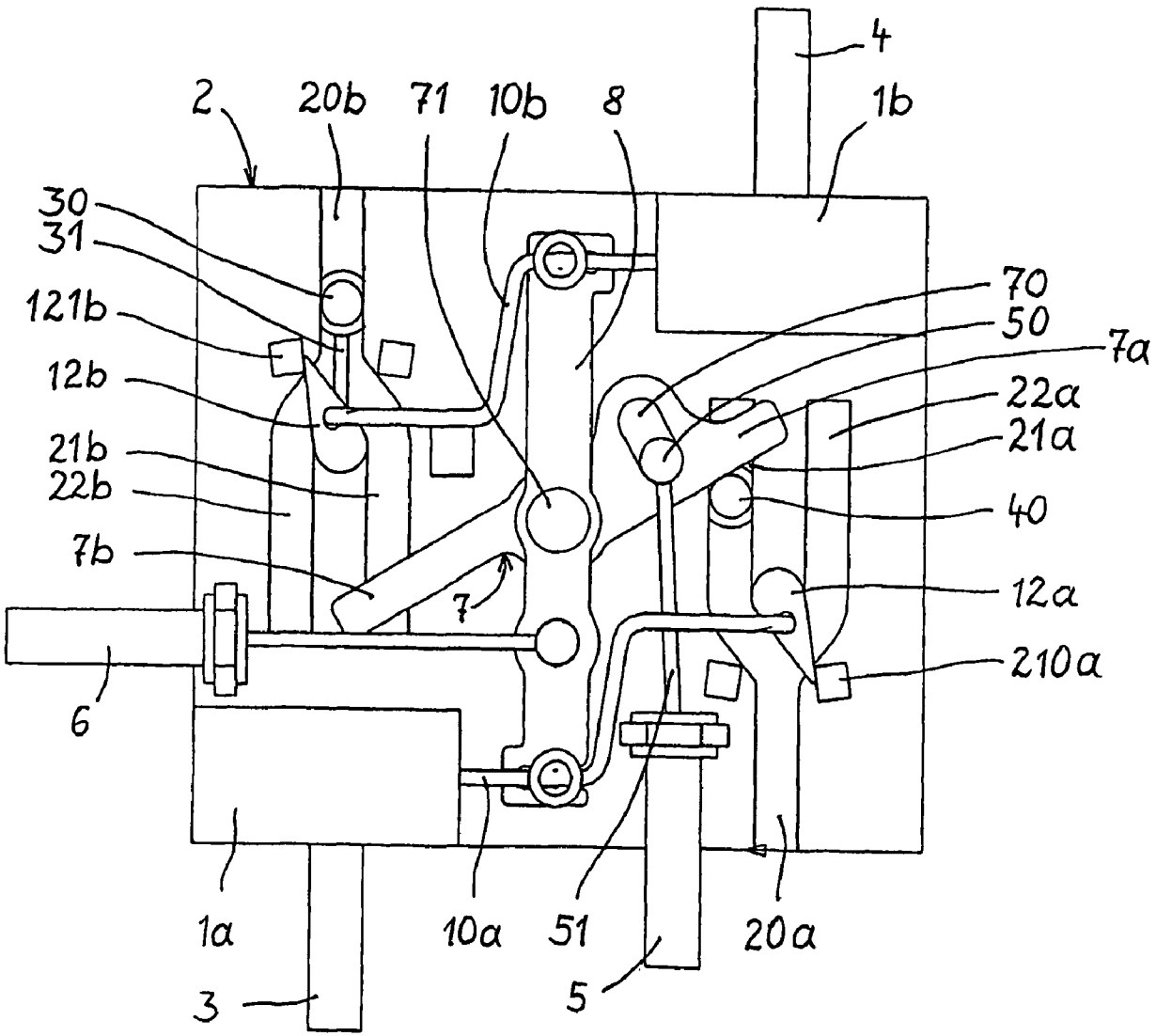
FIG. 3 is a plan view of the exemplary function controlling mechanism according to FIG. 1, but in the "ACTUATED" position controlled through the internal door opener.

If, in this state, one of the two door openers is actuated, the coupling element 30, 40 is moved towards the corresponding end 7*a*, 7*b* of the operating lever 7, which swivels about its axis 71. FIG. 3 shows a device actuated from the internal door operator, whose operating force is transferred via the Bowden tube end 4 and the cable pulley 41 to the coupling element 40 and causes the coupling element 40 to be displaced and to rotate the operating lever 7. This results in a displacement of the cable pulley 51, which is connected to the locking parts of the lock and which is engaged via a coupling element 50 with the operating lever 7 at a distance from the rotary axis 71. The oblong hole 70 serves as compensation for the cable pulley when the locking parts of the lock are in the so-called pre-catch position or when the door is opened but not in the closing position.

Figure 4:
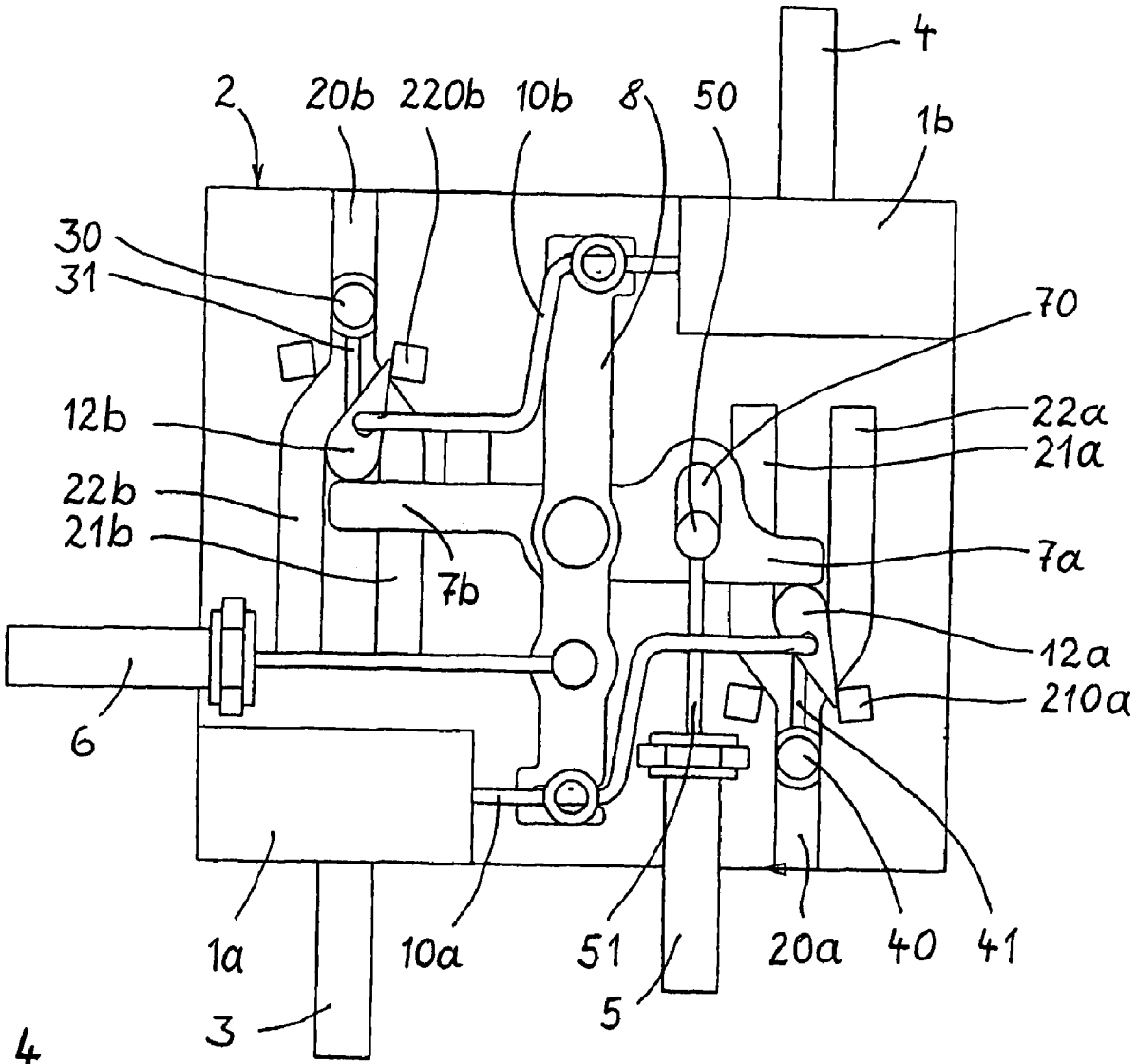
FIG. 4 is a plan view of the exemplary function controlling mechanism according to FIG. 1, but in the "LOCKED" position.

In FIG. 4—in comparison to FIG. 3—the switch element 12*b* was swivelled by the drive 1*b* via the coupling rod 10*b* towards the inner stop 220*b*, such that the outer guide track 22*b* is opened for the coupling element 30, which is connected to the external door opener via the Bowden tube end 3 and the cable pulley 31, but the inner guide track 21*b* is blocked. On actuating the external door handle it thus does not lead to engagement of the coupling element 30 with the operating lever 7 while the lock can be further actuated through the internal door handle. This switching state is termed "LOCKED".

Figure 5:
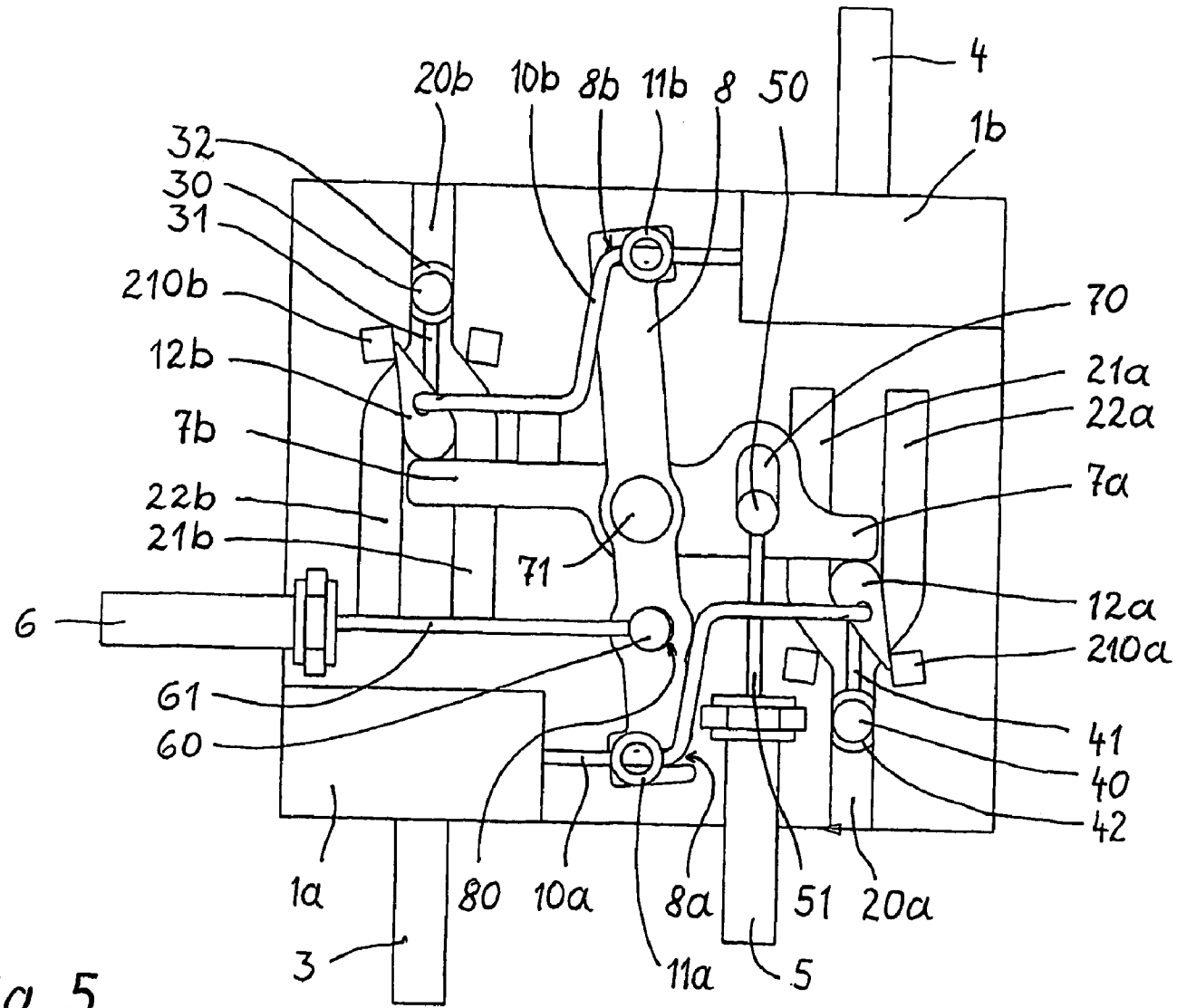
FIG. 5 is a plan view of the exemplary function controlling mechanism according to FIG. 1; but in the "EMERGENCY UNLOCKED" position controlled through the locking cylinder.

In order to be able to ensure emergency operation of the lock in the event of failure of the on-board electric supply, a switching lever 8 is provided which is likewise pivotally mounted on the axis 71 and engages with a coupling element 60 which is in active connection through a cable pulley 61 or a rod linkage with a locking cylinder. FIG. 5 shows the "EMERGENCY UNLOCKED" position in which the switch elements 12*a*, 12*b* are located in the position already shown in FIG. 2 so that the door lock can be opened by both door handles, i.e. inner and outer door handles. In the event of emergency unlocking by rotating the locking cylinder, the coupling element 60 is pressed against the switch lever 8 by the sufficiently stiff cable pulley 61, such that the switch lever 8 is pivoted. Stops at the ends 8*a*, 8*b* of the switch lever 8 thereby enter into engagement with followers 11*a*, 11*b*, which are attached to the coupling rod 10*a*, 10*b*, such that the switch elements 12*a*, 12*b*, which are connected to the respective coupling rods 10*a*, 10*b*, are moved in their unlocking position. If the function controlling mechanism has been in its "LOCKED" or "THEFT PROOF LOCKED" state prior to the emergency unlocking operation, the operation of the locking cylinder then causes the switch elements 12*a*, 12*b* to be pivoted against stops 210*a*, 210*b*.

Figure 6:
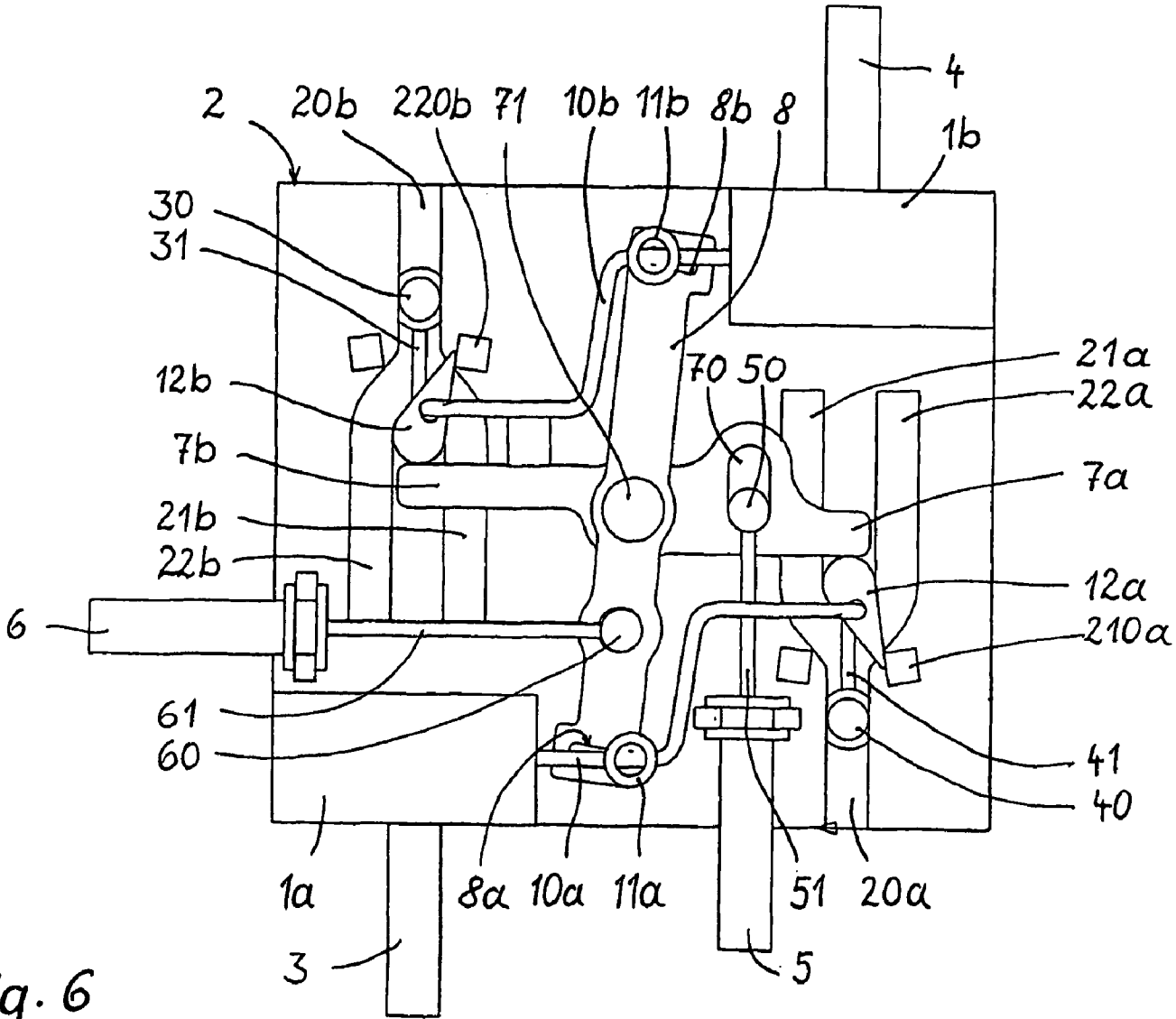
FIG. 6 is a plan view of the exemplary function controlling mechanism according to FIG. 1; but in the "EMERGENCY LOCKED" position controlled through the locking cylinder.

FIG. 6 shows the function controlling mechanism in the "EMERGENCY LOCKED" state. This is reached by an operating movement of the locking cylinder in the opposite direction, which, via the cable pulley 61, causes the switching lever 8 to be pivoted, such that the stop at the end 8*b* of the switch lever 8 is pressed against the follower 11*b* on the side of the external door opener and, by the displacement of the coupling rod 10*b*, the switch element 12*b* is pivoted against the inner stop 220*b*. Thus the engagement of the coupling element 30, which is connected to the external door opener via the Bowden tube end 3 and the cable pulley 31, with the associated end 7*b* of the operating lever 7 is prevented. For safety reasons this does not apply to the coupling element 40 on the side of the internal door opener, such that a person accidentally locked in the vehicle can free himself. Therefore, the stop at the end 8*a* of the switch lever 8 is open on one side and forms only a stop for the follower 11*a* for the emergency unlocking operation.

Figure 7:
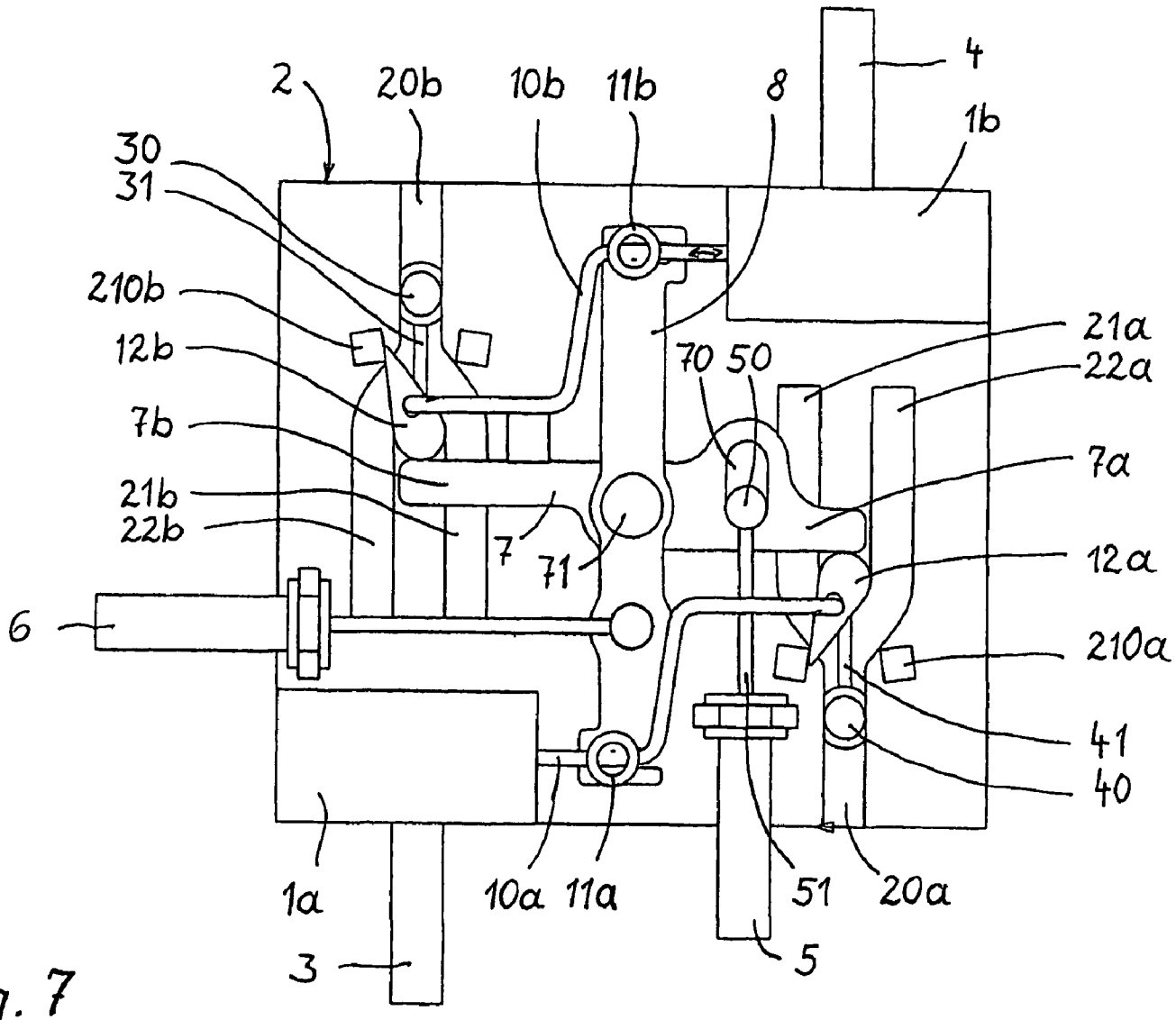
FIG. 7 is a plan view of the exemplary function controlling mechanism according to FIG. 1; but in the "CHILD LOCK" position.

FIG. 7 shows the "CHILD LOCK" position, in which the coupling element 40 on the side of the internal door opener upon actuation is deflected by the switch element 12*a* into the outer guide track 22*a*, such that the coupling element cannot engage with the operating lever 7 to unlock the door. The coupling element 30, at the same time, upon actuation by the outer door opener is deflected into the inner guide track 21*b* and, thus, engages with the operating lever 7 to unlock the door.

Figure 8:
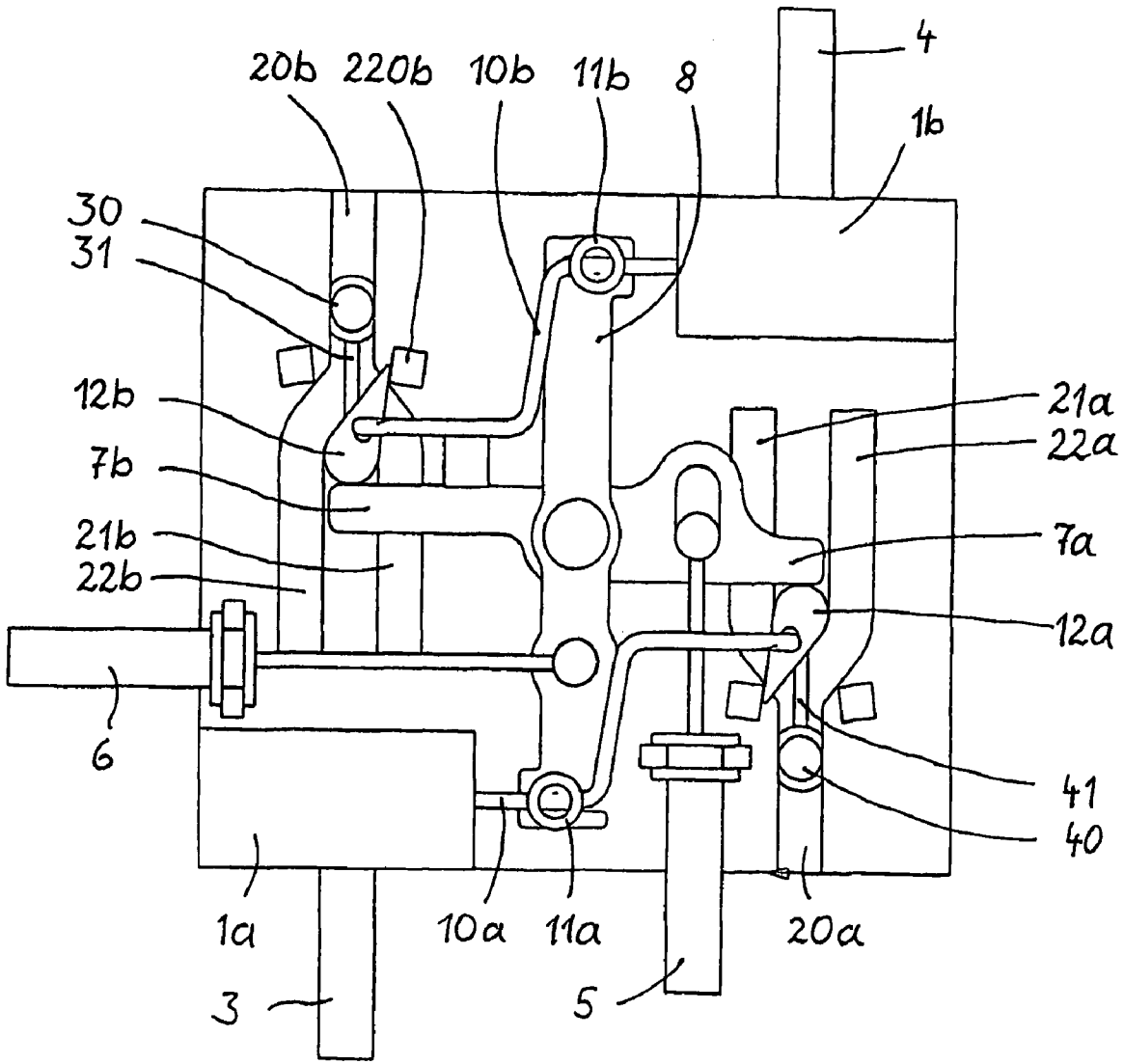
FIG. 8 shows a plan view of the exemplary function controlling mechanism according to FIG. 1; but in the "THEFT SECURED" position.

In the "THEFT PROOF LOCKED" position of FIG. 8, the inner guide tracks 21*a*, 21*b* are blocked by the switch elements 12*a*, 12*b* so that actuation of the lock is not possible either through the external door opener nor through the internal door opener. Changing over the switch elements 12*a*, 12*b* into the "UNLOCKED" state can—as already explained in connection with the previously described figures—take place by controlling the drives 1*a*, 1*b* or by operating the locking cylinder.

In various embodiments, base plate 2 can also be formed as a conductor plate of an electronic control unit. In particular electronic elements mounted between the base plates 2, 2' are particularly well protected from mechanical damage. The second base plate 2' can also function as a conductor plate as necessary. Monitoring the locked state can advantageously be carried out by sensors which sense the actual pivotal position of the switch elements 12*a*, 12*b*. In one exemplary embodiment, magneto-resistive elements may be advantageously used because they are comparatively insensitive to external influences.

Figure 9:
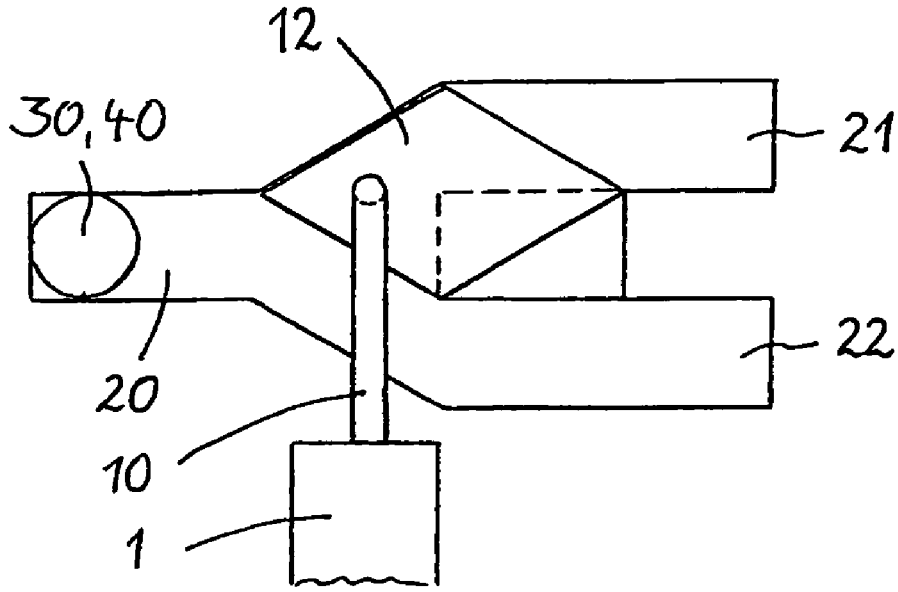
FIG. 9 is a diagrammatic view of an aspect of the present invention, including an exemplary points switch for the guide tracks of the coupling elements on the operating element side with a switch element which is transversely displaceable.

The diagrammatic illustration of FIG. 9 shows a neutral guide track 20 which is forked into two parallel guide tracks 21, 22 and a rhomboid shaped switch element 12 which is displaceable across the guide tracks and which is controllable by a drive 1 through a coupling rod 10.

Figure 10:
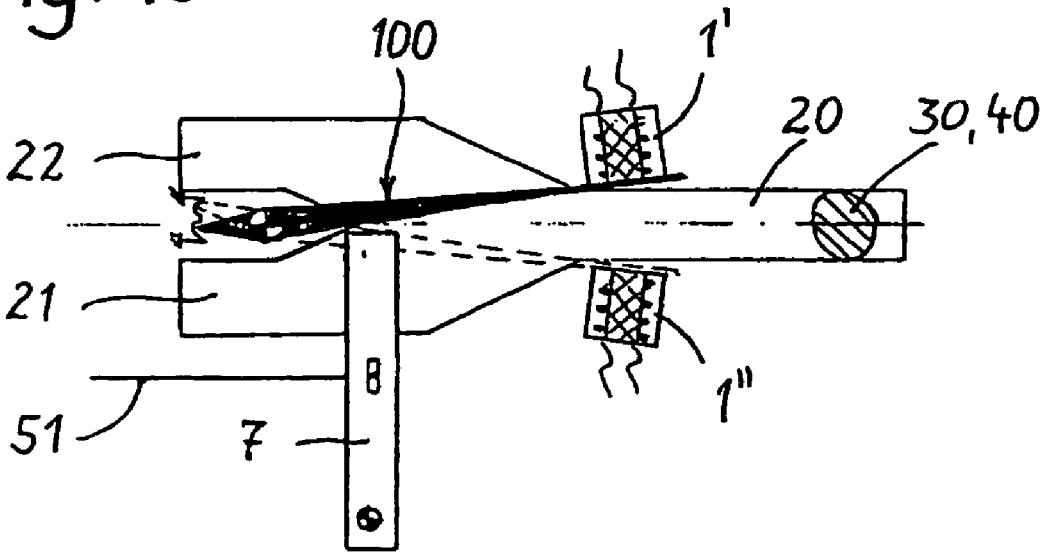
FIG. 10 is a diagrammatic view of an aspect of the present invention, including an exemplary points switch for the guide tracks of the coupling elements on the operating element side with an electromagnetic flap armature.

In another exemplary embodiment, the path of the coupling elements 30, 40 may be controlled on the operating element side along the forking guide tracks 20, 21, 22 as shown diagrammatically in FIG. 10. A pivotally mounted flap armature 100 is selectively controlled by coils 1', 1" which are arranged in the forked area on opposite sides of the neutral guide track 20 and which move the flap armature 100 by generating suitable magnetic forces and hold flap armature 100 in the desired position. Coils 1', 1" may also be referred to as electromagnets. In the illustrated armature position, the engagement of the coupling element 30, 40 on the operating lever 7 is provided. Swivel movement of operating lever 7 operates on the coupling rod 51 and is transferred into a push movement that is directed up to the door lock.

Figure 11:
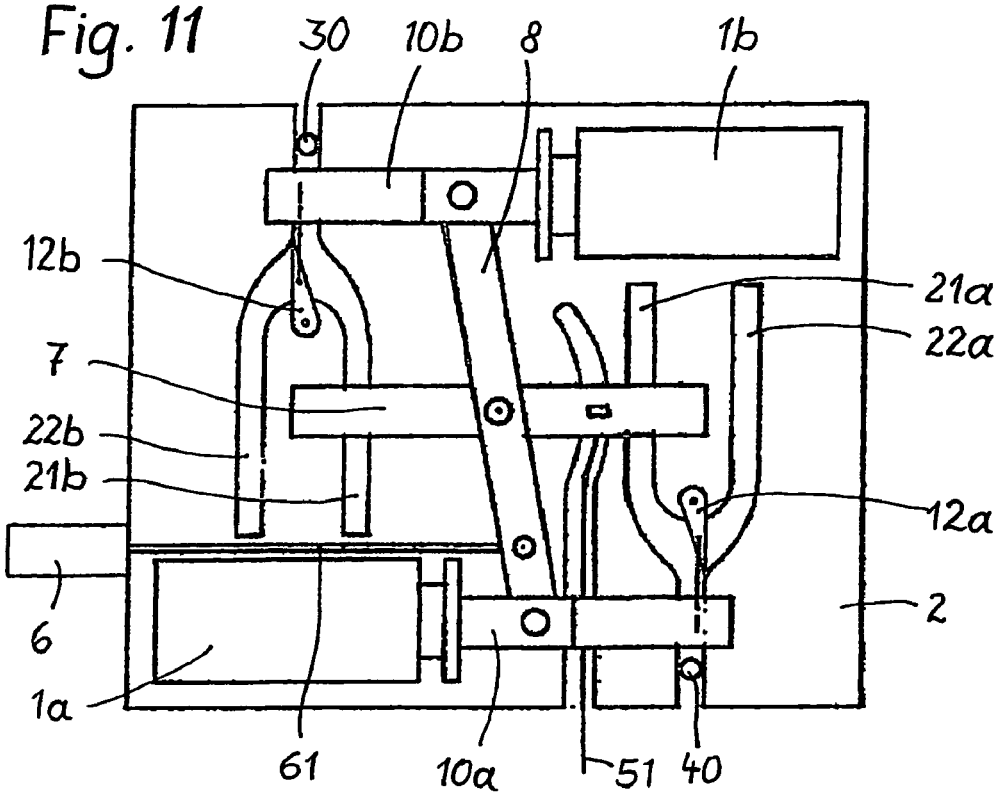
FIG. 11 is a diagrammatic view illustrating the points switch principle with swivel mounted switch element for function control.

FIG. 11 shows once again a diagrammatic illustration of the construction of a function controlling mechanism with forking guide tracks 21*a*, 21*b*, 22*a*, 22*b* and swivel switch elements 12*a*, 12*b* which are movable through coupling rods 10*a*, 10*b* between two end positions. Features and working principles of FIG. 11 are as described in conjunction with the embodiments of FIGS. 2 through 8.

Figure 12:
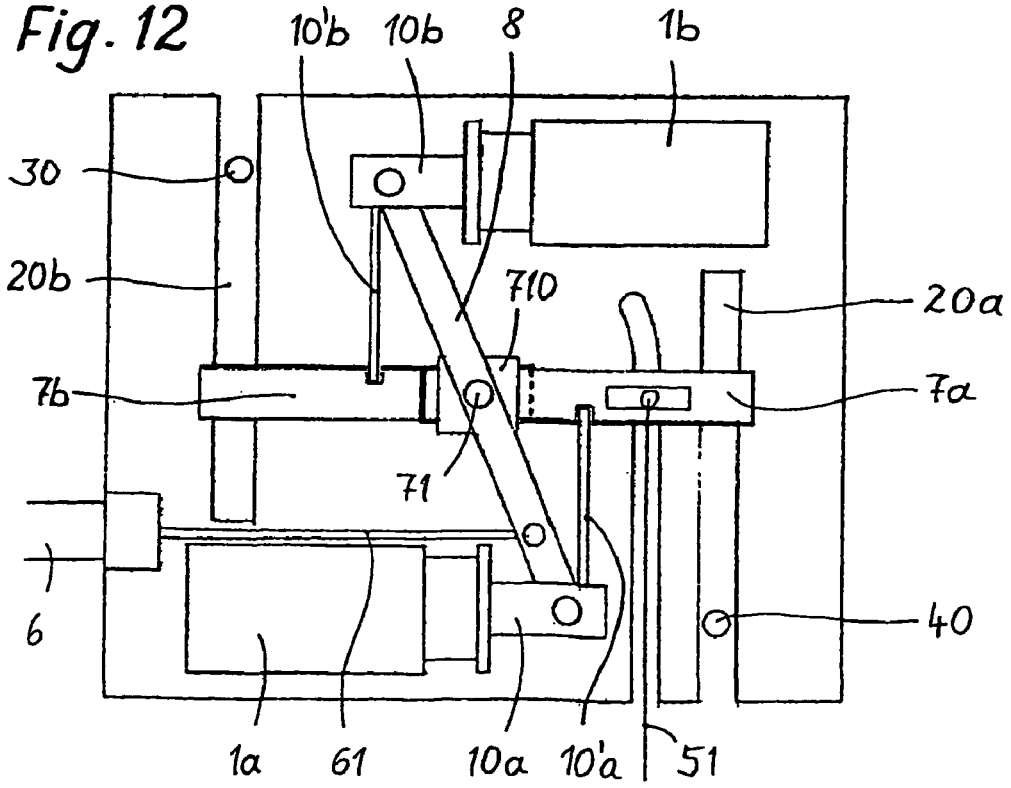
FIG. 12 is a diagrammatic view of an operating lever displaceable in the path of a simple guide track for function control.

The illustrated embodiment of FIG. 12 has for each coupling element 30, 40 on the operating element side only one simple (not-forked) guide track 20*a*, 20*b*. By using an operating lever which is basically divided into two parts 7*a*' and 7*b*' which are mounted displaceable independently of each other in a cassette 710, the free ends of the parts 7*a*', 7*b*' can selectively be brought into the guide track 20*a*, 20*b* and thus into the engagement area of the coupling elements 30, 40. In this manner, the operating lever halves 7*a*', 7*b*' are coupled to the drives 1*a*, 1*b* through a coupling rod linkage 10*a*, 10'*a*, 10*b*, 10'*b*. An emergency actuation for the purpose of emergency opening or emergency closing can take place through the switch lever 8 which is mounted in the common pivotal axis 71 and which is connected to the locking cylinder through the connecting element 6 and the cable or rod linkage 61.

Figure 13:
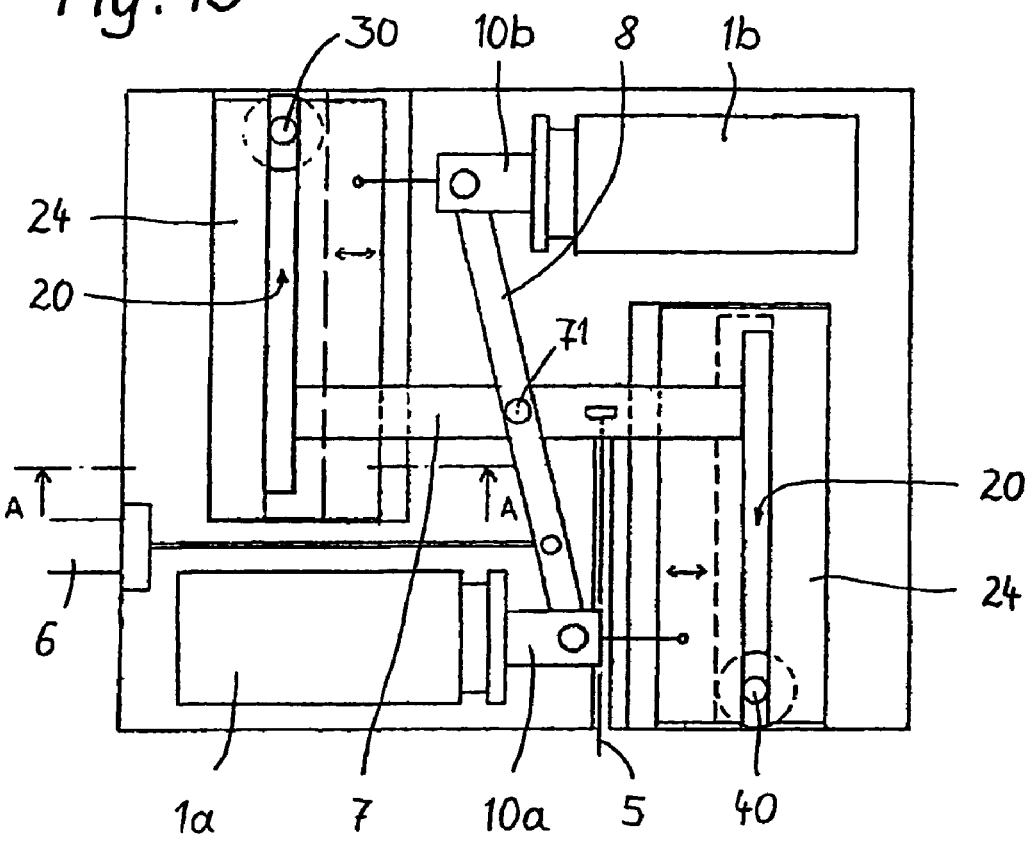
FIG. 13 is a diagrammatic view of simple guide tracks transversely displaceable in the engagement area of the operating lever for function control.
Figure 14:
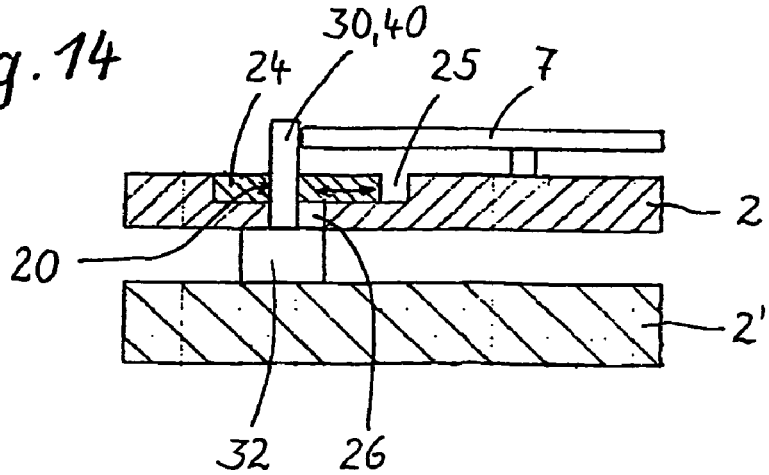
FIG. 14 is a cross-sectional view through a region of the device shown in FIG. 13.

Also the function controlling mechanism shown in FIG. 13 uses only simple (non-forked) guide tracks 20. Compared with the embodiment of FIG. 12 the guide track 20 of FIG. 13 is a constituent part of a transversely displaceable part 24 which is mounted in a channel-like recess 25 of the base plate 2. The coupling element 30, 40 thereby engages through a slit 26 which is formed in the base plate 2 underneath the guide track 20 with a width designed so that there is sufficient clearance for the proposed transverse displacement of the coupling elements 30, 40 (see also FIG. 14). According to FIGS. 13 and 14, the operating lever 7 does not cross the transversely displaceable guide track 20 so that with the introduction of an operating force none of the coupling elements 30, 40 can act on the associated free end of the operating lever 7. This system is thus located in the "THEFT PROOF LOCKED" state.

A further possibility which selectively enables or prevents the engagement of a coupling element 30, 40 on the operating lever 7 exists in selectively varying the projection height of the coupling elements 30, 40 from the region between the base plates 2, 2' towards the operating lever 7. For example, the projection height may be maximised when the operating force is to be transferred through the coupling element 7 to the locking parts of the lock (see FIGS. 15 and 16). If on the other hand a transfer of the operating force through at least one of the coupling elements 30, 40 is to be prevented because, for example, the system is locked, theft proof locked or child locked, then the coupling element 30, 40 may be guided along an inclined plane which reduces the projection depth to an extent which is less than required for engagement with the operating lever 7.

Figure 15:
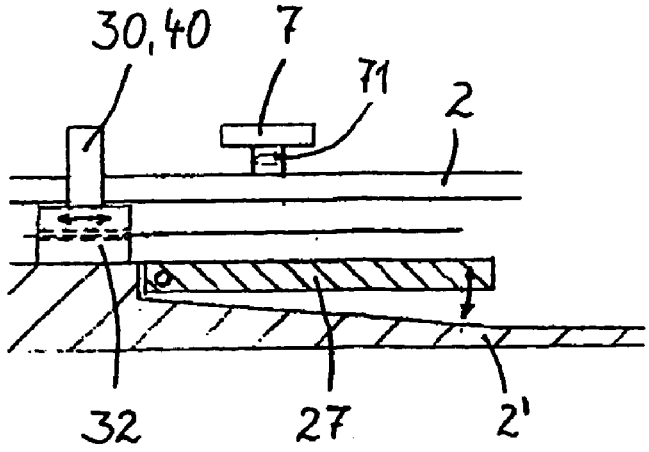
FIG. 15 is a cross-sectional view through a region of the function controlling mechanism having a pivotal guide plane for the coupling element on the operating element side for function control.
Figure 16:
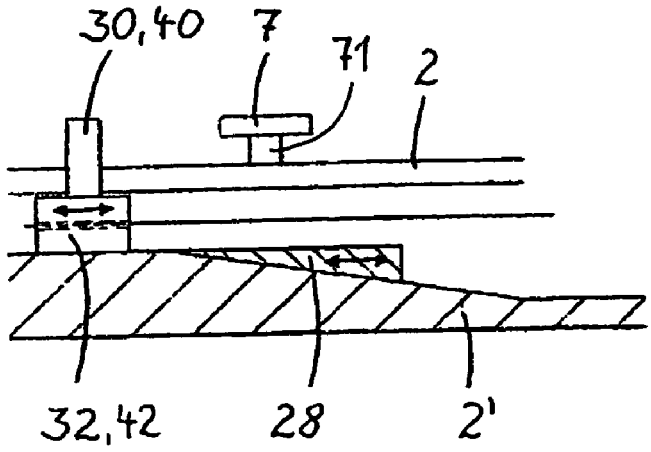
FIG. 16 is a cross-sectional view through a region of the function controlling mechanism with a displaceable wedge for the coupling element on the operating element side for function control.
Figure 17:
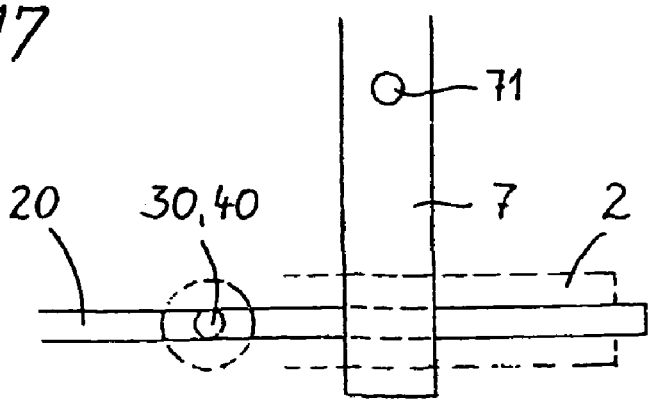
FIG. 17 is a diagrammatic view of the embodiments shown in FIGS. 15 and 16.

FIGS. 15 and 16 show two exemplary embodiments that produce such inclined planes which represent the switching states of the function controlling device. In FIG. 15, a part 27 is pivotally mounted on the base plate 2' and its position determines the projection depth of the coupling element 30, 40. In FIG. 16, a displaceable wedge 28 is provided whose wedge angle corresponds to that of the inclined plane underneath which is released during its displacement and then reduces the projection depth to a measure which lets the coupling element pass through under the operating lever. In the position of the web 28 shown in FIG. 16 this wedge forms with its outer contour, an extension of the plane of the base plate 2' running parallel to the guide track 20. FIG. 17 shows a diagrammatic plan view of the devices shown in cross-section in FIGS. 15 and 16.

Figure 18:
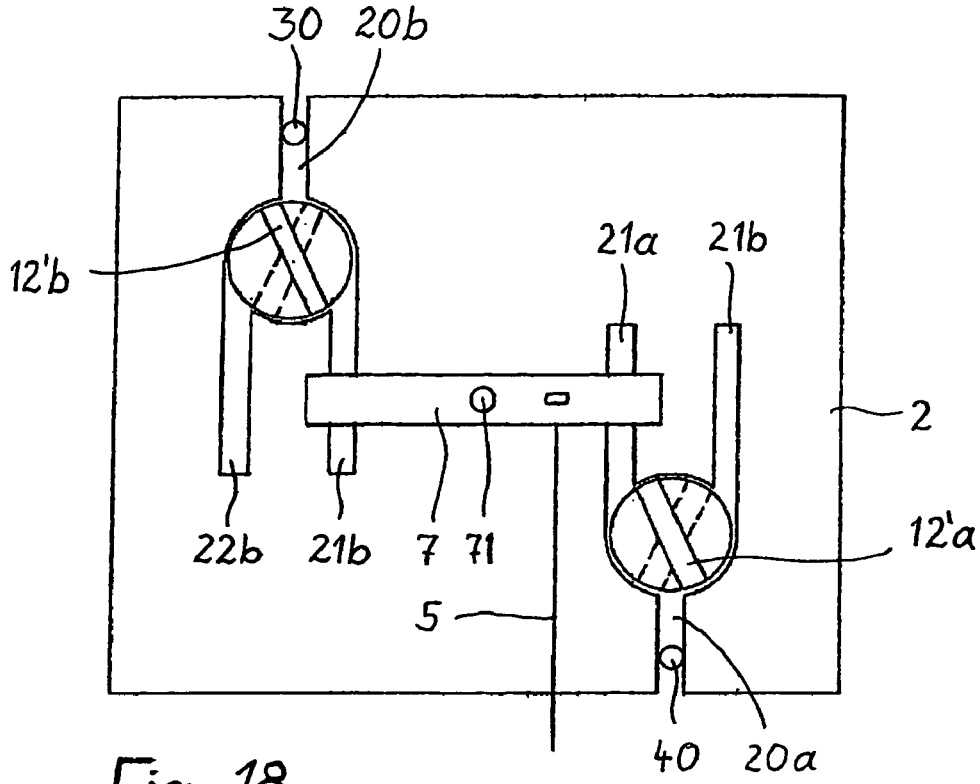
FIG. 18 is a diagrammatic view illustrating the points switch principle by using a rotary armature or rotary magnet for function control.

FIG. 18 shows diagrammatically the control principle already illustrated and described with reference to FIGS. 1 to 8 by using a neutral guide track 20*a*, 20*b* which is forked into two guide tracks 21*a*, 21*b*, 22*a*, 22*b* whereby the displacement path is controlled through a points-like switch element. The exemplary displacement element 12'*a*, 12'*b* is constructed on the principle of a rotary magnet or rotary armature which can be alternately rotated between two end positions.

Figure 19:
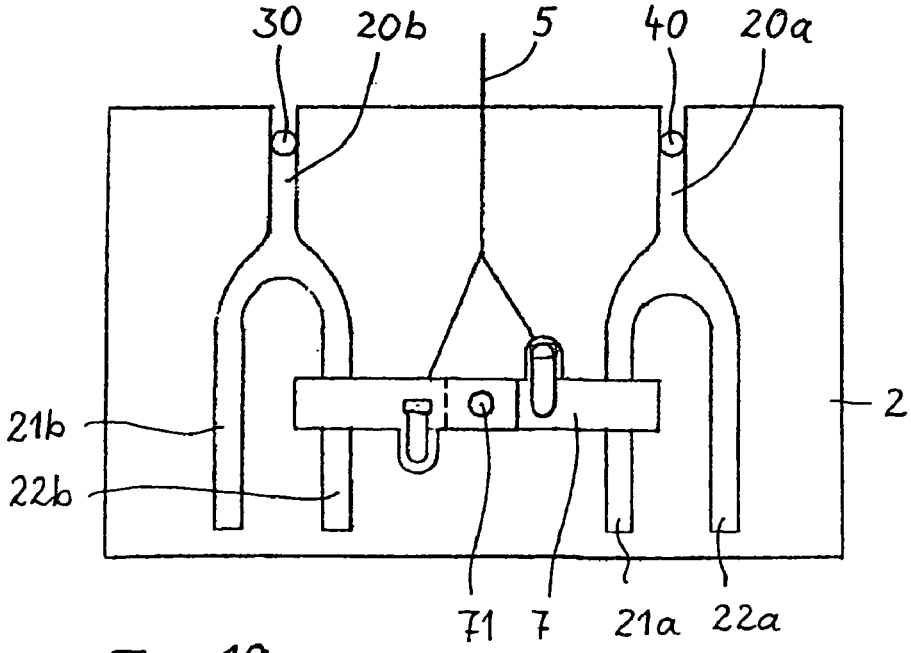
FIG. 19 is a diagrammatic view of mirror-parallel arranged fork-like guide tracks.

FIGS. 19 to 23 show some variations of exemplary symmetrical arrangements of the parts and function regions of the function controlling mechanism according to the invention. FIG. 19 shows an exemplary symmetrical mirror arrangement of parallel and unidirectional guide tracks 20*a*, 20*b*, 21*a*, 21*b*, 22*a*, 22*b*. FIGS. 20 and 21 show a function controlling mechanism having a symmetrical construction relative to the base plate 2' with superposed base plates 2*a*, 2*b* supporting the guide tracks 20, 20*a*, 20*b*, 21, 21*a*, 21*b*, 22, 22*a*, 22*b*. These are associated with the drives 1, the coupling elements 30, 40 as well as the divided areas 7*a*, 7*b* of the operating lever which are mounted on a common axis 71.

Figure 22:
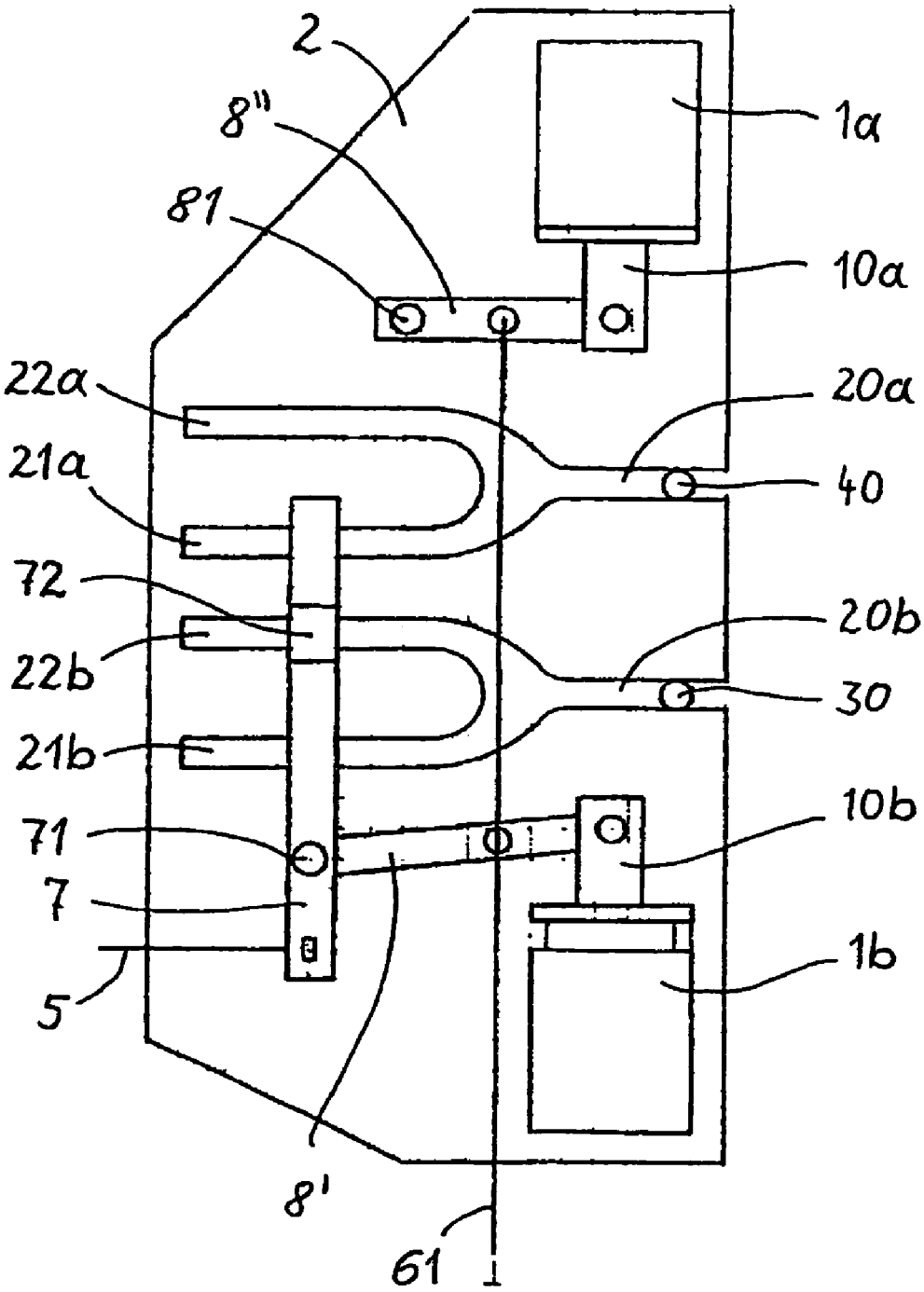
FIG. 22 is a diagrammatic view of mirror parallel fork-like guide tracks and a pair of switch levers.

FIG. 22 shows—similar to FIG. 19—symmetrical and unidirectional mounted guide tracks 20*a*, 20*b*, 21*a*, 21*b*, 22*a*, 22*b* whose switch elements (not shown) are likewise associated with mirror symmetrical drives 1*a*, 1*b* which can be switched through parts 10*a*, 10*b*, 8', 8", 61. This embodiment has two switch levers 8', 8" whereby each individual part (i.e. each switch lever) is mounted on one side on the coupling rod 10*a*, or 10*b* of the drive 1*a*, 1*b*, and on the other hand in a swivel axis 71, 81 which is fixed on the base plate 2. Between these connecting points, operating means 61 engage on the switch lever 8', 8" in order to be able to initiate emergency operation through the locking cylinder as necessary. The operating lever 7 is pivotally mounted in the axis 71 and crosses the guide tracks 21*a*, 21*b* so that with a corresponding setting of the switch elements (not shown) an engagement can be produced with the coupling elements 30, 40. The operating lever 7 may also be formed to be U-shaped, for example, in the intersection area, so that the coupling element 30 can "tunnel under" the operating lever 7 without stopping against the same. Operating lever 7 may include bridging area 72.

Figure 23:
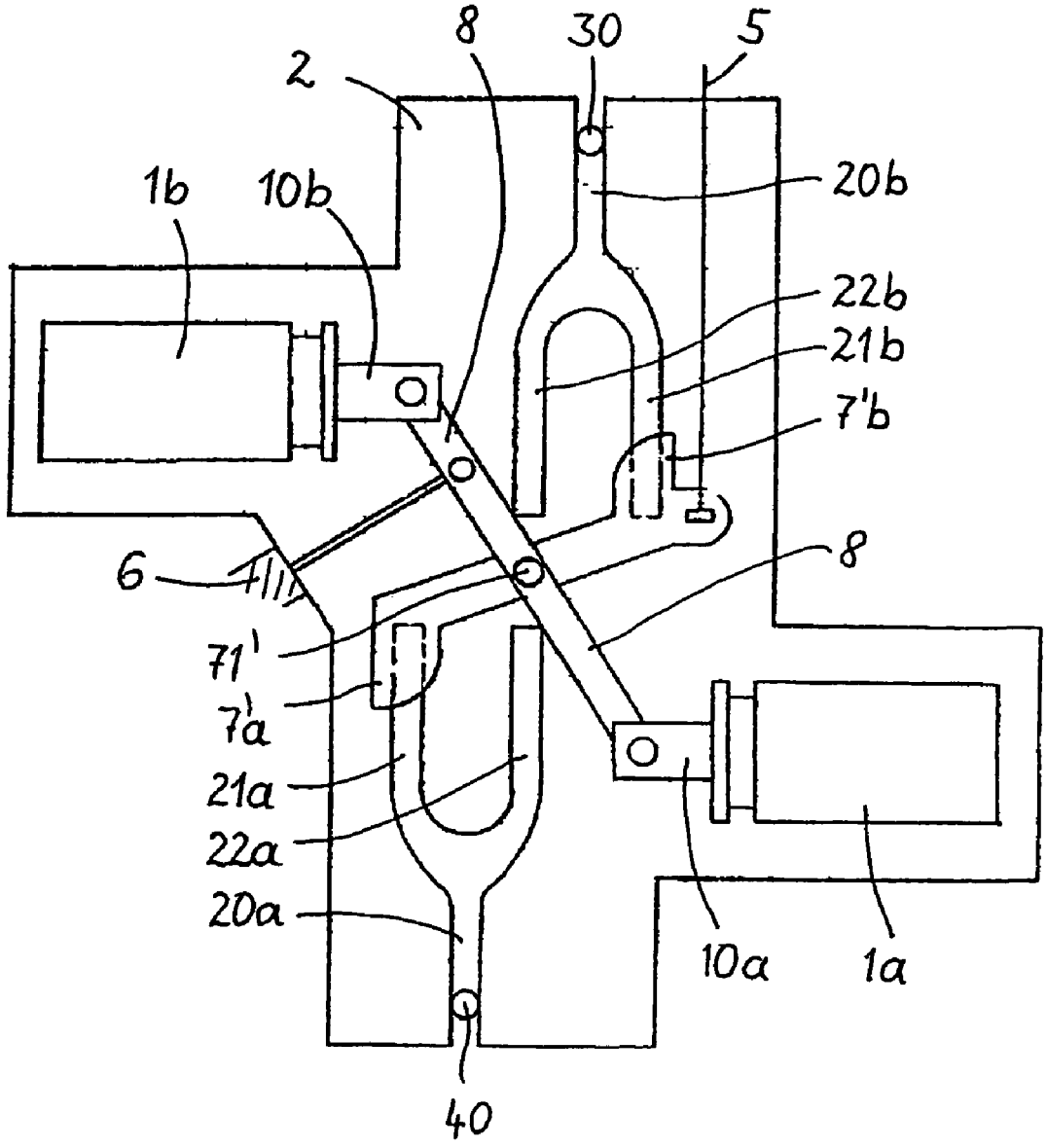
FIG. 23 is a diagrammatic view of an axially symmetrical function controlling mechanism.

The function controlling mechanism according to FIG. 23 is constructed to be generally symmetrical relative to the swivel axis 71' whereby the swivel axis 71' is not anchored on the base plate 2 but can move slightly as a result of the selected lever kinematics in the case of the switch processes emanating from the drives 1*a*, 1*b* or the locking cylinder (see connecting element 6). Lever ends 7'*a* and 7'*b* are displaceable parts of the operating lever. An illustration of the points-like switch elements and their coupling rods with the drives has been omitted as these features have been discussed previously.

Figure 24:
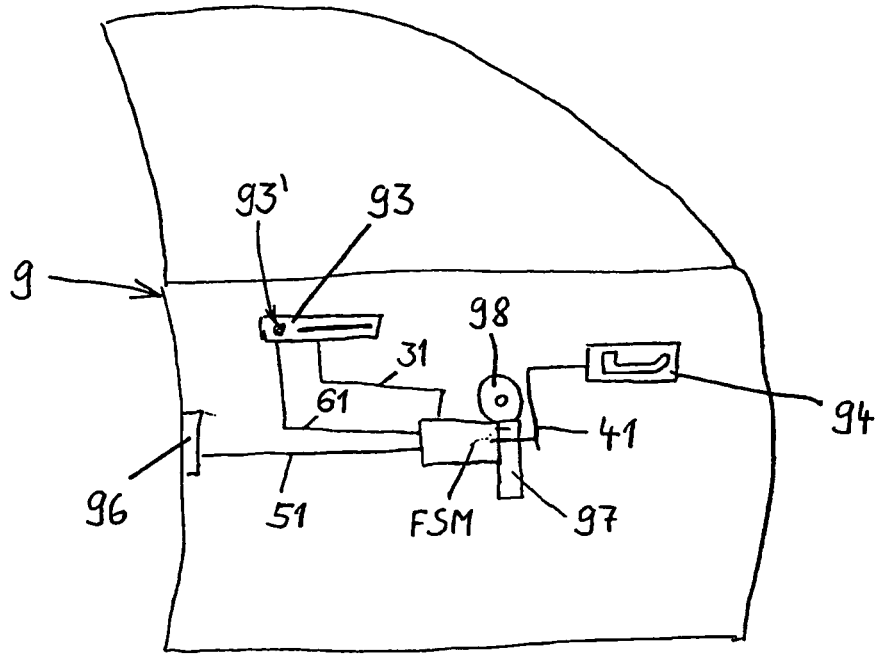
FIG. 24 is a diagrammatic side view of a motor vehicle door with function devices.

FIG. 24 shows in a diagrammatic illustration the side view of a vehicle door 9 with a function controlling mechanism FSM into which an electronic control for the lock 96, as well as a window lifter, is integrated. The window lifter motor 97 is advantageously in direct connection with the function controlling mechanism FSM which is also provided with current according to this exemplary embodiment. FIG. 24 also illustrates gearing 98. The operating forces and setting paths between the external door handle (i.e. door opener) 93, the locking cylinder 93', the internal door handle (i.e. internal door opener) 94 and the door lock 96 on the one hand, and the function controlling mechanism on the other, are transferred through Bowden cables or rod linkages 31, 41, 51, 61.

Figure 25:
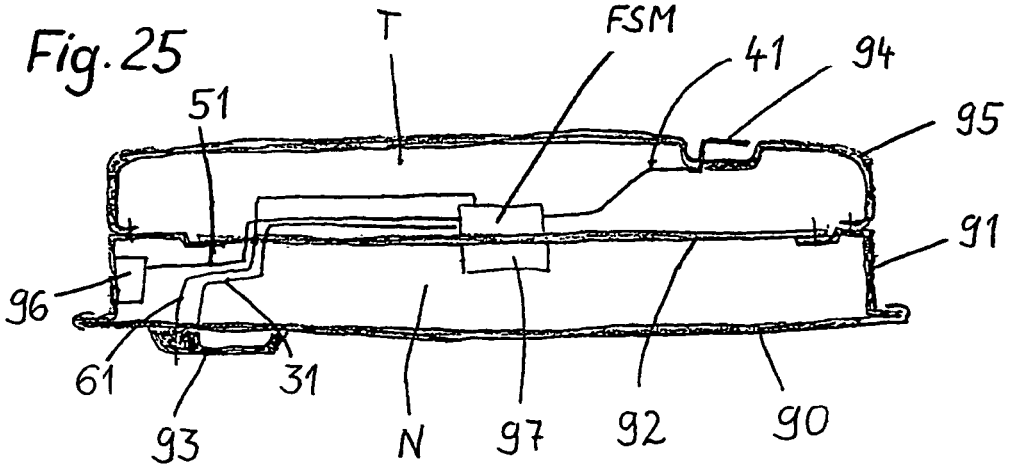
FIG. 25 is a diagrammatic view of a cross-section through a vehicle door.

FIG. 25 shows a cross-sectional view of the described exemplary vehicle door. In FIG. 25, the door body is divided into a wet space N defined by the outside door panel 90 and inside door panel 91 and thus support plate 92 connected thereto, and a dry space T which extends between the support plate 92 and the inside door trim 95. As many function units as possible of the vehicle door are preferably preassembled on the support plate 92 in order to achieve one comprehensively pre-checkable assembly system.

The invention claimed is:

1. Lock system for controlling the lock states of a motor vehicle door, comprising at least one locking part of a lock for mechanically locking the door, at least one operating element for exerting an operating force onto the at least one locking part, the operating element including an operating device, at least one coupling assembly for transferring the operating force from the operating device to the at least one locking part, at least one switch element controlling the movement of the at least one coupling assembly and lying outside of a force transfer path between the at least one operating element and the at least one locking part, and at least two substantially parallel mounted guide tracks for guiding an operating side coupling element of the at least one coupling assembly, the guide tracks including a first guide track and a second guide track, wherein the operating side coupling element, depending on a position of the at least one switch element, is guidable along the first guide track so as to be brought into active connection with the at least one locking part, and is guidable along the second guide track so as to not be brought into active connection with the at least one locking part.

2. Lock system according to claim 1, wherein the at least one switch element is controllable by a drive and controls movement of the operating side coupling element, wherein depending on the position of the at least one switch element, the operating side coupling element enters into active connection with a locking side coupling element of the at least one coupling assembly to transfer movement from the operating device to the locking part.

3. Lock system according to claim 2, wherein the at least one switch element can occupy solely discrete end positions.

4. Lock system according to claim 3, wherein the end positions are defined by corresponding stops.

5. Lock system according to one of claims 2 to 4, wherein the drive is one of a lift magnet, a rotary magnet and a flap armature device.

6. Lock system according to claim 1, wherein the operating side coupling element is in engagement with a neutral guide track having at least one fork connected to the first guide track and the second guide track such that the at least one switch element functions as a points switching element whereby the first guide track guides the operating side coupling element into active connection with a locking side coupling element of the at least one coupling assembly and the second guide track prevents an active connection from being established between the operating side coupling element and the locking side coupling element.

7. Lock system according to claim 6, wherein at least one of the first, second and neutral guide tracks is formed as a slide track, or a slot in which the operating side coupling element is guided.

8. Lock system according to claim 6, wherein at least one of the first, second and neutral guide tracks is formed as a rail on which the operating side coupling element is guided.

9. Lock system according to claim 6, wherein the points switching element is mounted pivotally or rotatably relative to a base that supports the first guide track, second guide track and neutral guide track.

10. Lock system according to claim 1, wherein the operating side coupling element is displaceably mounted along an inclinable plane whereby a displacement of the operating side coupling element along the inclinable plane prevents coupling of the operating side coupling element with a locking side coupling element of the at least one coupling assembly.

11. Lock system according to claim 10, wherein the inclinable plane is inclined by swiveling a pivotal element which is mounted on a base.

12. Lock system according to claim 10, wherein the inclinable plane is disposed beneath a displaceable wedge, and wherein the inclinable plane is inclined by displacing the displaceable wedge to release the inclinable plane from underneath the displaceable wedge.

13. Lock system according to claim 1, wherein the operating side coupling element is displaceably mounted along a single track transversely displaceable to define any one of the first guide track and the second guide track, the single track being transversely displaceable relative to an extension direction of the operating side coupling element so that engagement of the operating side coupling element with a locking side coupling element of the at least one coupling assembly is selectively interruptable.

14. Lock system according to claim 1, wherein a locking side coupling element of the at least one coupling assembly or an operating lever connected to the locking part, can be displaced or pivoted in the first guide track so that the operating lever crosses the first guide track and is engageable with the operating side coupling element.

15. Lock system according to claim 1, wherein a force-transferring means is directly connected to the operating side coupling element and is mounted on the one side of a base supporting the at least two substantially parallel mounted guide tracks, wherein a locking side coupling element of the at least one coupling assembly is mounted on the other side of the base, and wherein the operating side coupling element engages through the base an operating lever connected to the locking side coupling element when the operating side coupling element is displaced along the first guide track.

16. Lock system according to claim 1, wherein the lock system is at least partially symmetrical with respect to an external door opener side and an internal door opener side.

17. Lock system according to claim 16, wherein the lock system includes at least one of a symmetry relative to a plane intersecting a base so that a plurality of structural elements and a plurality of function regions of the lock system are mounted on the base adjacent one another and with parallel alignment, a symmetry relative to an axis intersecting the base so that the plurality of structural elements and the plurality of function regions of the lock system are mounted on the base side by side with non-parallel off-set alignment, and a symmetry relative to a plane parallel to a respective base of a plurality of bases of the lock system so that the plurality of structural elements and the plurality of function regions of the lock system are mounted superposed on different respective bases, wherein the plurality of function regions comprise the at least one switch element, the first guide track, the second guide track, a drive operatively coupled to the at least one switch element and configured to control the at least one switch element, and wherein the plurality of structural elements comprise the at least one coupling assembly including the operating side coupling element and a locking side coupling element.

18. Lock system according to claim 1, further comprising a pivotally mounted switch lever having ends with stops connected to respective followers of a control rod linkage connected to at least one drive, the switch lever engaging a force transfer element between a swivel axis, of the switch lever and one of the ends, the force transfer element connected to a locking cylinder of the vehicle door so that during actuation of the locking cylinder in an opening direction or closing direction, the at least one switch element can be brought into switch position for the purpose of emergency opening or emergency closing.

19. Lock system according to claim 1, further comprising a pivotally mounted operating lever being pivotable about a pivot axis, the operating lever having an end that engages at least one coupling element of the coupling assembly, wherein the at least one coupling element pivots the operating lever about the pivot axis to couple the operating lever to the locking part.

20. Lock system according to claim 1, further comprising an electronic lock control.

21. Lock system according to claim 20, wherein the lock system and the electronic lock control form one structural unit.

22. Lock system according to claim 21, further comprising a conductor plate for the electronic lock control and which further serves as a mechanical support.

23. Lock system according to claim 22, wherein the conductor plate includes at least one of:

the at least two substantially parallel guide tracks for receiving the operating side coupling element, bearing sites for the at least one switch element and pivotal axis disposed thereon, and fixing sites for at least one of drives, plugs, switches and sensors for determining the lock state.

24. Lock system according to claim 20, further comprising the electronic lock control connected to an antenna supported by a housing or integrated in a plastic wall of the electronic lock system.

25. Lock system according to claim 1, wherein the second guide track is defined by parallel displacement of the first guide track.

26. Lock system as in claim 1, wherein the at least one locking part comprises at least one of a latch and a locking pawl.

27. Lock systems as in claim 1, wherein the lock states comprise unlocked, locked, theft proof and child lock.

28. Lock systems as in claim 1, wherein the at least one operating device comprises at least one of an external door opener and an internal door opener.

29. Lock systems as in claim 2, wherein the force transferring means include a Bowden cable.

30. Lock system as in claim 18, further comprising an operating lever being pivotally mounted in its middle region, the operating lever having a pivot axis, the operating lever having ends, wherein depending on the position of the at least one switch element, one of the ends is engageable with at least one coupling element of the at least one coupling assembly, and wherein the operating lever swivels about the pivot axis to engage the at least one locking part through a force transfer element engaged between the pivot axis and one of the ends of the operating lever, the operating lever and a lever of the at least one switch element being mounted on a common axis.

* * * * *

UNITED STATES PATENT AND TRADEMARK OFFICE

CERTIFICATE OF CORRECTION

PATENT NO. : 7,086,257 B2
APPLICATION NO. : 10/432142
DATED : August 8, 2006
INVENTOR(S) : Bücker et al.

It is certified that error appears in the above-identified patent and that said Letters Patent is hereby corrected as shown below:

In the Claims

| | |
|---|---|
| Column 13, line 13, Claim 27 | Delete "systems",<br>Insert --system-- |
| Column 13, line 15, Claim 28 | Delete "systems",<br>Insert --system-- |
| Column 14, line 1, Claim 29 | Delete "systems",<br>Insert --system-- |

Signed and Sealed this

Twenty-seventh Day of March, 2007

JON W. DUDAS
*Director of the United States Patent and Trademark Office*